US010051361B2

(12) United States Patent
Morin

(10) Patent No.: US 10,051,361 B2
(45) Date of Patent: Aug. 14, 2018

(54) PASSIVE SOUND PROLIFERATION DEVICE AND METHODS OF USING THE PASSIVE SOUND PROLIFERATION DEVICE

(71) Applicant: Joseph Dieudonne Morin, Springville, UT (US)

(72) Inventor: Joseph Dieudonne Morin, Springville, UT (US)

( * ) Notice: Subject to any disclaimer, the term of this patent is extended or adjusted under 35 U.S.C. 154(b) by 8 days.

(21) Appl. No.: 15/299,863

(22) Filed: Oct. 21, 2016

(65) Prior Publication Data

US 2017/0118554 A1 Apr. 27, 2017

Related U.S. Application Data

(60) Provisional application No. 62/245,426, filed on Oct. 23, 2015.

(51) Int. Cl.

| | |
|---|---|
| ***H04R 1/34*** | (2006.01) |
| ***G10K 11/08*** | (2006.01) |
| *H04R 1/02* | (2006.01) |
| *A45C 11/00* | (2006.01) |
| *H04R 1/30* | (2006.01) |

(52) U.S. Cl.

CPC ..... *H04R 1/345* (2013.01); *G10K 11/08* (2013.01); *H04R 1/34* (2013.01); *A45C 2011/002* (2013.01); *H04R 1/026* (2013.01); *H04R 1/30* (2013.01); *H04R 2205/021* (2013.01); *H04R 2499/11* (2013.01)

(58) Field of Classification Search

CPC .... H04R 2205/021; H04R 1/345; H04R 1/30; H04R 1/028; H04R 1/34; H04M 1/035; G10K 11/08; A45C 2011/002

See application file for complete search history.

(56) References Cited

U.S. PATENT DOCUMENTS

| | | | | |
|---|---|---|---|---|
| 8,256,568 | B2 * | 9/2012 | Lin | H04B 1/3888 181/176 |
| 8,428,665 | B1 * | 4/2013 | McLaughlin | H04M 1/05 455/128 |
| D684,142 | S * | 6/2013 | Sun | D14/208 |
| 8,520,370 | B2 * | 8/2013 | Waitzman, III | G02B 27/027 359/802 |
| D689,476 | S * | 9/2013 | Alexander | D14/209.1 |
| 8,522,917 | B1 * | 9/2013 | Oh | G10K 11/08 181/148 |
| 8,528,690 | B1 * | 9/2013 | Wu | G10K 11/025 181/152 |

(Continued)

*Primary Examiner* — Joshua Kaufman

(74) *Attorney, Agent, or Firm* — TraskBritt

(57) ABSTRACT

An apparatus comprises an electronic device having at least one speaker and a passive sound proliferation device comprising an audio cavity. The audio cavity is configured to proliferate acoustic waves therefrom and is defined by at least a substantially planar back wall, a substantially planar side wall, an arcuate surface between the substantially planar side wall and the substantially planar back wall, and a substantially planar inner bottom surface. The passive sound proliferation device may further include a substantially planar outer side surface and a substantially planar outer bottom surface substantially perpendicular to the substantially planar outer side surface. The electronic device may be disposed within the audio cavity. Related methods of directing audio from a passive sound proliferation device are disclosed.

14 Claims, 18 Drawing Sheets

(56) References Cited

U.S. PATENT DOCUMENTS

| | | | | |
|---|---|---|---|---|
| 9,117,435 | B2 * | 8/2015 | Huang | G10K 11/002 |
| 9,241,055 | B1 * | 1/2016 | Barker | H04M 1/04 |
| 9,389,641 | B2 * | 7/2016 | Jayetileke | A45C 11/00 |
| 9,874,902 | B2 * | 1/2018 | McCracken | G06F 1/1632 |
| 2002/0009195 | A1 * | 1/2002 | Schon | B60R 11/0241 379/454 |
| 2007/0223745 | A1 * | 9/2007 | Feng | H04M 1/04 381/160 |
| 2010/0183179 | A1 * | 7/2010 | Griffin, Jr. | H04R 1/2857 381/337 |
| 2010/0219012 | A1 * | 9/2010 | Baumbach | G10K 11/025 181/177 |
| 2011/0170725 | A1 * | 7/2011 | Liu | H04R 1/02 381/338 |
| 2012/0063630 | A1 * | 3/2012 | Maezawa | H04R 1/345 381/386 |
| 2012/0140970 | A1 * | 6/2012 | Kim | H04R 5/02 381/340 |
| 2012/0147487 | A1 * | 6/2012 | Waitzman | G02B 27/027 359/804 |
| 2012/0303146 | A1 * | 11/2012 | Genov | H04R 1/30 700/94 |
| 2014/0105425 | A1 * | 4/2014 | Chu | G10K 11/025 381/120 |
| 2015/0034411 | A1 * | 2/2015 | Huang | G10K 11/002 181/202 |
| 2017/0004814 | A1 * | 1/2017 | Scheller | G10K 11/08 |

* cited by examiner

PASSIVE SOUND PROLIFERATION DEVICE AND METHODS OF USING THE PASSIVE SOUND PROLIFERATION DEVICE

CROSS-REFERENCE TO RELATED APPLICATION

This application claims the benefit of U.S. Provisional Patent Application Ser. No. 62/245,426, filed Oct. 23, 2015, and entitled "PASSIVE SOUND PROLIFERATION DEVICE AND METHOD OF USING THE PASSIVE SOUND PROLIFERATION DEVICE," the disclosure of which application is hereby incorporated herein in its entirety by this reference.

TECHNICAL FIELD

Embodiments of the disclosure relate generally to a passive sound proliferation device shaped and configured to passively direct sounds emitted from an electronic device, such as a mobile telephone, tablet, media player, or other device disposed within the passive sound proliferation device, and to related methods.

BACKGROUND

Users of electronic devices, such as mobile telephones, may desire to listen to audio sounds originating from their electronic devices. Speakers of many electronic devices, such as mobile telephones, are not suitable for generating high volume sounds. The speakers of such devices are configured primarily for allowing a person to hear the sounds emanating from the speakers only when the person is in close proximity to the device. Thus, the volume from such an electronic device may not be sufficient to enable a user to hear or enjoy listening to sounds originating from the speakers, particularly when the user is located at a distance from the electronic device. In addition, at higher volumes, some electronic devices do not produce high quality sounds. However, users of such electronic devices may desire to listen to music or other sounds emanating from the electronic device from a distance while they are not in close proximity to the electronic device.

BRIEF SUMMARY

Embodiments disclosed herein include structures shaped and configured to passively proliferate sounds originating from an audio source within the structure. For example, in accordance with one embodiment, an apparatus comprises a passive sound proliferation comprising an audio cavity configured to proliferate acoustic waves therefrom, the audio cavity defined by at least a substantially planar back wall, a substantially planar side wall, an arcuate surface between the substantially planar side wall and the substantially planar back wall, and a substantially planar inner bottom surface, a substantially planar outer side surface, and a substantially planar outer bottom surface substantially perpendicular to the substantially planar outer side surface.

In additional embodiments, a passive sound proliferation device comprises an audio cavity configured to proliferate acoustic waves therefrom, the audio cavity at least partially defined by a back wall, a side wall, a front wall, and an inner bottom surface, a substantially planar outer side surface opposing the side wall, and a substantially planar outer bottom surface opposing the inner bottom surface, wherein the passive sound proliferation device is configured to be disposed on a planar surface on one of the substantially planar outer side surface or the substantially planar outer bottom surface.

In yet additional embodiments, a method of directing audio from a passive sound proliferation device comprises providing an electronic device in an audio cavity of a passive sound proliferation device, directing audio from the audio cavity of the passive sound proliferation device away from the passive sound proliferation device, wherein the audio cavity is defined by at least a substantially planar back wall, a substantially planar inner bottom surface, a substantially planar side wall, and an arcuate surface between the substantially planar back wall and the substantially planar side wall, and providing an opening in the substantially planar inner bottom surface configured to accept a power cable of the electronic device.

DETAILED DESCRIPTION

Figure 1:
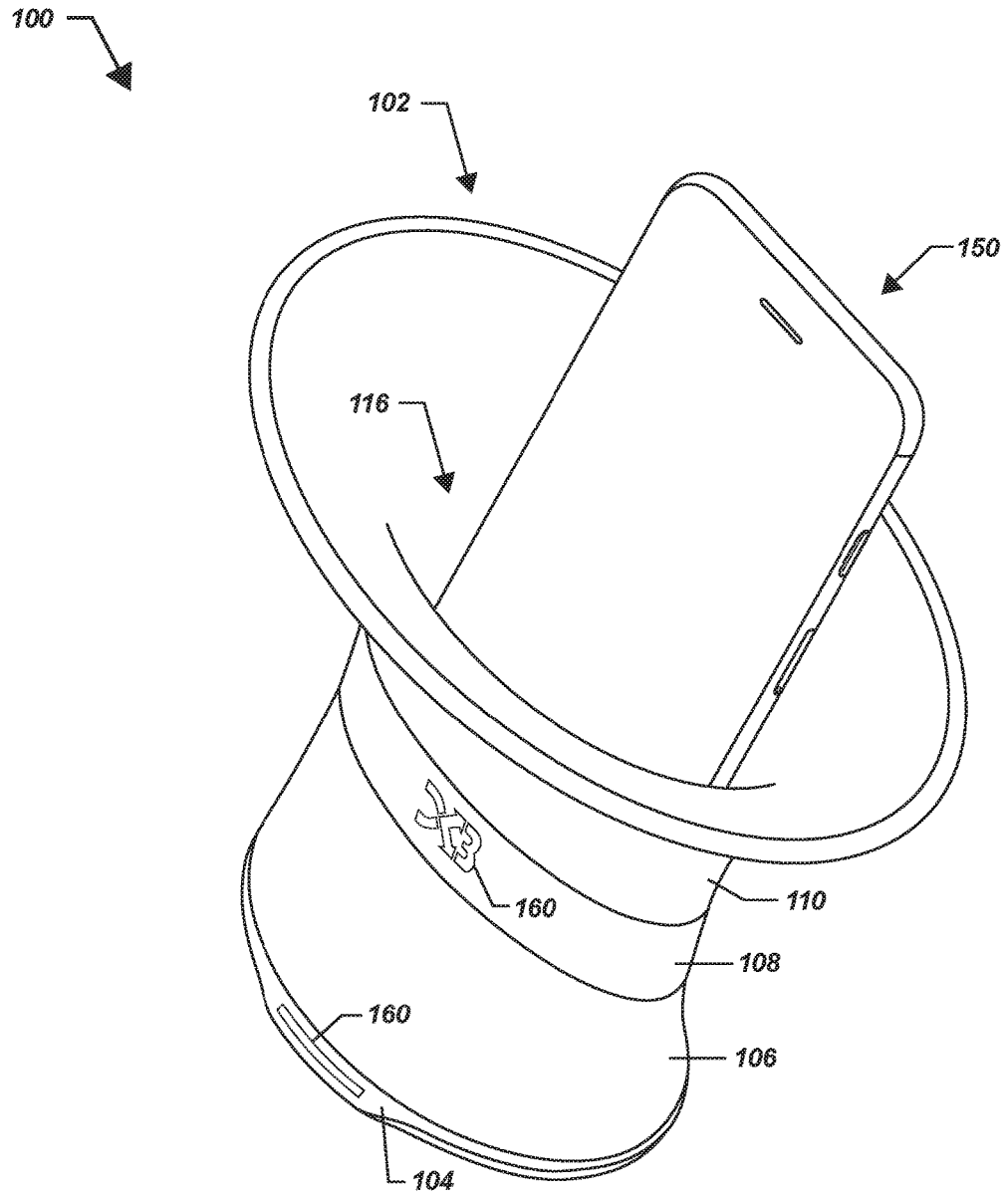
FIG. 1 is a simplified perspective view of a passive sound proliferation device in accordance with embodiments of the disclosure.

Illustrations presented herein are not meant to be actual views of any particular material, component, or system, but are merely idealized representations that are employed to describe embodiments of the disclosure.

As used herein, the term "electronic device" means and includes any of a phone (e.g., a cellular telephone), a tablet, a media player, or any device with a speaker. The electronic device may be powered with a battery, powered via a direct electrical connection, or may be configured to selectively be powered by a battery or a direct electrical connection.

The following description provides specific details, such as material types, compositions, material thicknesses, and processing conditions in order to provide a thorough description of embodiments of the disclosure. However, a person of ordinary skill in the art will understand that the embodiments of the disclosure may be practiced without employing these specific details. Indeed, the embodiments of the disclosure may be practiced in conjunction with conventional techniques employed in the industry. In addition, the description provided below does not form a complete process flow for forming or using a passive sound proliferation device. Only those process acts and structures necessary to understand the embodiments of the disclosure are described in detail below. A person of ordinary skill in the art will understand that adding various conventional components and acts would be in accord with the disclosure. Additional acts or materials to form or use a passive sound proliferation device may be performed by conventional techniques.

Users of electronic devices, such as mobile telephones, frequently desire to listen to music, watch movies, or engage in other activities that involve listening to sounds originating from the electronic devices. Frequently, users of such electronic devices may desire to listen to sounds originating from their devices from a distance (e.g., such as by placing a mobile telephone on "speaker mode"). In some embodiments, users may desire to view a screen while listening to noise originating from the electronic device (e.g., such as while watching a movie, a video, etc.). However, many electronic devices suffer from sound systems (e.g., speakers) of relatively poor quality. For example, speakers of many electronic devices are not capable of producing high volume sounds such that a user can adequately hear sounds originating from the speakers, particularly when the user is located at a distance from the electronic device.

According to embodiments disclosed herein, a passive sound proliferation device is configured to receive an electronic device therein. The passive sound proliferation device is sized, shaped, and configured to direct acoustic waves (e.g., audio sounds) originating from the electronic device out of (e.g., away from) the passive sound proliferation device. The passive sound proliferation device may include curved surfaces that are sized and shaped to direct acoustic waves from within the device through an audio cavity of the passive sound proliferation device. The audio cavity may be oval-shaped, an elongated circular shape, elliptical-shaped, or may include other shapes having a major axis and a minor axis, as described herein. In some embodiments, at least a portion of the passive sound proliferation device may be horn-shaped, vase-shaped, or may include other curved surfaces configured to direct acoustic waves out of the passive sound proliferation device. In other embodiments, the passive sound proliferation device includes at least one substantially planar surface configured to orient a screen of the electronic device in a so-called "landscape" and at least another substantially planar surface configured to orient the screen of the electronic device in a so-called "portrait" position while the electronic device is disposed in the passive sound proliferation device. The acoustic waves exiting the audio cavity may appear to a user to exhibit a higher volume than sounds originating from the electronic device without the passive sound proliferation device. Thus, by placing the electronic device in the passive sound proliferation device, the user may hear audio from the electronic device more clearly and loudly, particularly when the user is located some distance from the electronic device. Stated another way, the passive sound proliferation device may enhance a user's experience or enhance an apparent quality or clarity of sound perceived by the user.

Referring to FIG. 1, a simplified perspective view of a passive sound proliferation device 100 is illustrated. The passive sound proliferation device 100 may include an opening 102 at least partially defining an audio cavity 116 sized and configured to receive an electronic device 150, such as a mobile telephone, an iPOD®, an iPAD®, a tablet, or other electronic device including a speaker capable of producing sound, such as an earbud, an earphone, or other sound-emitting device that fits within the opening 102. In use and operation, the electronic device 150 may at least partially extend beyond the opening 102.

The passive sound proliferation device 100 may further include a base plate 104, a base portion 106, a middle portion 108, and a top portion 110. The base plate 104 may be sized and shaped to support the passive sound proliferation device 100. When the passive sound proliferation device 100 is in an upright position, the base plate 104 may contact a surface on which the passive sound proliferation device 100 rests. The base plate 104 may include a bottom surface configured to frictionally grip the surface in contact with the base plate 104 (and on which the passive sound proliferation device 100 rests). By way of nonlimiting example, when the passive sound proliferation device 100 is in an upright position, the base plate 104 may contact a surface of a table, a countertop, or other surface on which the passive sound proliferation device 100 rests. One or more logos 160 may be painted or imprinted onto a surface (e.g., an exterior surface) of the passive sound proliferation device 100.

The passive sound proliferation device 100 may be formed of a material having a uniform composition. In some embodiments, each of the base plate 104, the base portion 106, the middle portion 108, and the top portion 110 may be formed of the same material. In other embodiments, at least one of the base plate 104, the base portion 106, the middle portion 108, and the top portion 110 may be formed of a different material than at least another of the plate 104, the base portion 106, the middle portion 108, and the top portion 110.

The passive sound proliferation device 100 may be formed by one or more of injection molding, compression molding, casting, or other suitable method, and may include any suitable material that may be formed by such methods, such as, for example, a metal, a plastic, a ceramic (e.g., glass), an elastomer, a thermoplastic, a thermosetting polymer, wood, or a combination thereof. In some embodiments, the passive sound proliferation device 100 includes a thermoplastic, such as, for example, an acrylic resin, polyvinyl chloride (PVC), polyetheramide, polymethyl methylacrylate (PMMA), a compression molded elastomer, or combinations thereof. In some embodiments, the material of the passive sound proliferation device 100 may be substantially transparent to visible light.

Exterior surfaces of the passive sound proliferation device 100 may be substantially smooth. One or more portions of the passive sound proliferation device 100 may be painted. Some portions of the passive sound proliferation device 100 may include a gloss paint and other portions thereof may include a matte paint. The paint may be an opaque or clear paint, such as a clear acrylic paint. In some embodiments, the passive sound proliferation device 100 is transparent to visible light and some surfaces thereof (e.g., internal surfaces of the base portion 106 or internal surfaces 118 (FIG. 2) of the audio cavity 116) are painted.

Figure 2:
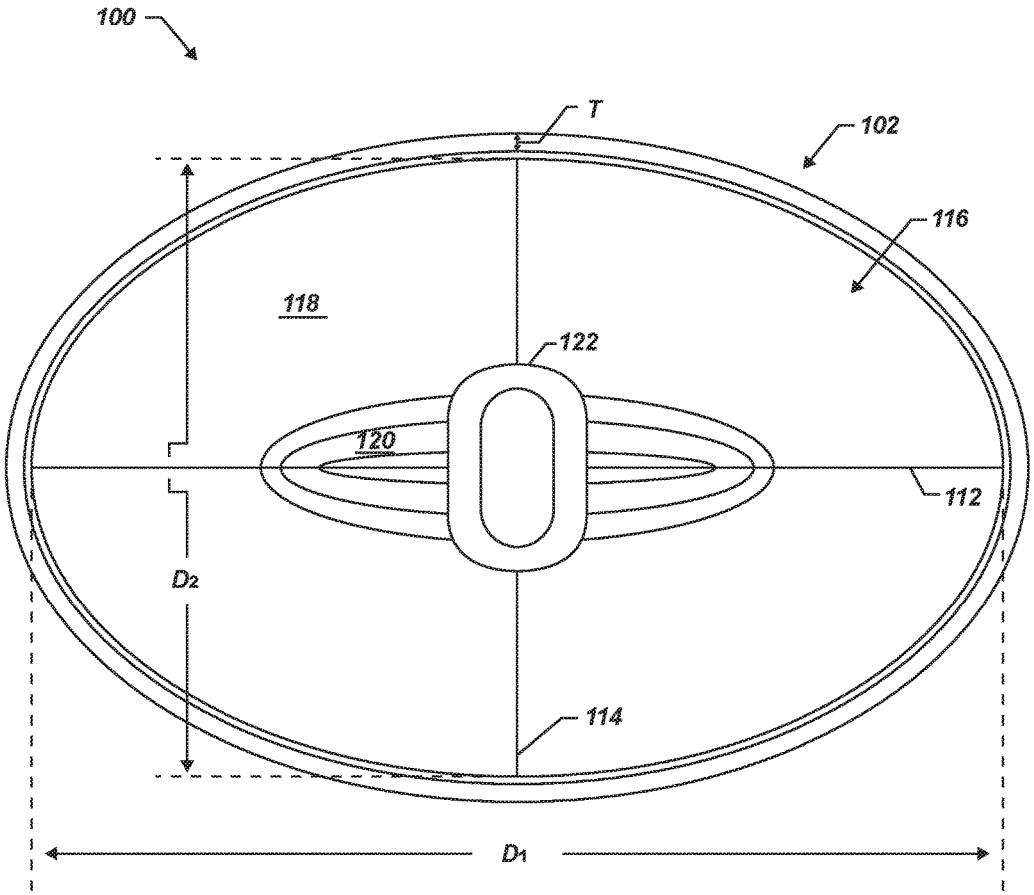
FIG. 2 is a top view of the passive sound proliferation device of FIG. 1.

FIG. 2 is a top view of the passive sound proliferation device 100. The audio cavity 116, in which the electronic device 150 (FIG. 1) may be disposed, may be defined by interior surfaces 118 of the top portion 110 (FIG. 1). The audio cavity 116 may further be defined by a surface (e.g., a substantially planar surface, a rounded surface, etc.) 120 on which the electronic device 150 may rest.

A wall thickness T of the passive sound proliferation device 100 may be between about 0.5 mm and about 5.0 mm, such as between about 0.5 mm and about 1.0 mm, between about 1.0 mm and about 2.0 mm, between about 2.0 mm and about 3.0 mm, between about 3.0 mm and about 4.0 mm, or between about 4.0 mm and about 5.0 mm. The wall thickness may be selected based on a size of the electronic device to be received in the audio cavity 116. A wall thickness of the base portion 106 may be greater than a wall thickness of the middle portion 108 and a wall thickness of the middle portion 108 may be greater than a wall thickness of the top portion 110. The wall thickness of the passive sound proliferation device 100 may vary from, for example, a greater wall thickness at the base portion 106 to a lesser wall thickness at the top portion 110, such as proximate the opening 102. Stated another way, the passive sound proliferation device 100 may comprise a varying thickness along a length thereof. In some embodiments, a wall thickness of the top portion 110 proximate the opening 102 may be between about 0.5 mm and about 1.0 mm, between about 1.0 mm and about 2.0 mm, or between about 2.0 mm and about 3.0 mm. A wall thickness of the base portion 106 may be between about 4.0 mm and about 5.0 mm. Although the passive sound proliferation device 100 has been described above as having particular wall thicknesses, the disclosure is not so limited and the passive sound proliferation device 100 may have greater or smaller wall thicknesses than those described above.

In some embodiments, the opening 102 may be defined by a two-dimensional shape defined by a major axis 112 and a minor axis 114, such as an oval, an elongated circle, an ellipse, a rectangle, or other elongated (e.g., oblong) shapes. The major axis 112 may be defined as a largest distance between antipodal points (i.e., points that are diametrically opposite each other such that a line drawn through the antipodal points also passes through the center of the shape). The minor axis 114 of the opening 102 may be defined by a smallest distance between antipodal points. In some embodiments, the opening 102 comprises an oval shape. In some embodiments, the opening 102 may be an ellipse. As used herein, an ellipse (or an elliptical shape) means and includes a shape surrounding two focal points (i.e., foci), such that a sum of the distances from a point of the ellipse to the two focal points is constant for every point on the ellipse, as is defined in the art. The ellipse may have two perpendicular axes about which the ellipse is symmetric. A major axis 112 of the ellipse may be defined by a largest distance between antipodal points (i.e., points that are diametrically opposite each other such that a line drawn through the antipodal points also passes through the center of the ellipse), as is known in the art. A minor axis 114 of the ellipse may be defined by a smallest distance between antipodal points, as is known in the art. The ellipse may have an eccentricity (c), which may be defined as a ratio of a distance between the two foci of the ellipse to a length of the major axis. The eccentricity may be between about 0 and about 0.99. When the eccentricity is 0, the foci coincide at the center point of the ellipse and the ellipse is a circle. Ellipses with a larger eccentricity may have a more elongated shape than ellipses with a lower eccentricity. In other embodiments, the opening 102 has a rectangular shape, the major axis of which is defined by a length of a largest side of the rectangle and a minor axis of which is defined by a length of a smallest side of the rectangle. Thus, although the illustrations presented herein depict the opening 102 as an oval shape, the opening 102 may include other oblong shapes, such as a rectangle, an elongated circle, etc.

A length $D_1$ of the major axis 112 of the opening 102 may be larger than a length $D_2$ of the minor axis 114 of the opening 102. In some embodiments, such as where the electronic device 150 (FIG. 1) comprises a phone, $D_1$ may be between about 120 mm and about 180 mm, such as between about 130 mm and about 170 mm, between about 140 mm and about 160 mm, or between about 150 mm and about 160 mm. In some embodiments, $D_1$ is equal to about 155 mm. $D_2$ may be between about 70 mm and about 130 mm, such as between about 80 mm and about 120 mm, between about 90 mm and about 110 mm, or between about 95 mm and about 105 mm. In some embodiments, $D_2$ is about 100 mm. A ratio of $D_2$ to $D_1$ may be equal to between about 0.2 and about 1.0, such as between about 0.3 and about 0.9, between about 0.4 and about 0.8, between about 0.5 and about 0.7, or between about 0.6 and about 0.7. In some embodiments, the ratio is equal to about 0.66. The ratio of $D_2$:$D_1$ may remain substantially constant along a longitudinal axis (i.e., an axis into and out of the plane illustrated in FIG. 2) of the passive sound proliferation device 100. In other embodiments, a value of the ratio may increase along a longitudinal axis of the passive sound proliferation device 100 with a lower value proximate the middle portion 108 and a higher value proximate the opening 102. In other words, in some embodiments, a cross-section of the opening 102 may become more circular proximate the middle portion 108 or the base portion 106 relative to the top portion 110. In some embodiments, such as where the electronic device 150 comprises a larger electronic device (e.g., a larger cellular telephone), $D_1$ may be between about 150 mm and about 200 mm, such as between about 160 mm and about 180 mm, or between about 165 mm and about 175 mm. In some embodiments, $D_1$ may be about 170 mm.

The top portion 110 may include an internal cavity 122 configured to receive a power cable for charging the electronic device 150 during use and operation. The internal cavity 122 may include a generally oval cross-sectional shape, a major axis of which may be substantially perpendicular to the major axis 112 that partially defines the top portion 110. In other embodiments, a cross-section of the internal cavity 122 may be circular-shaped or elliptical-shaped.

Figure 3:
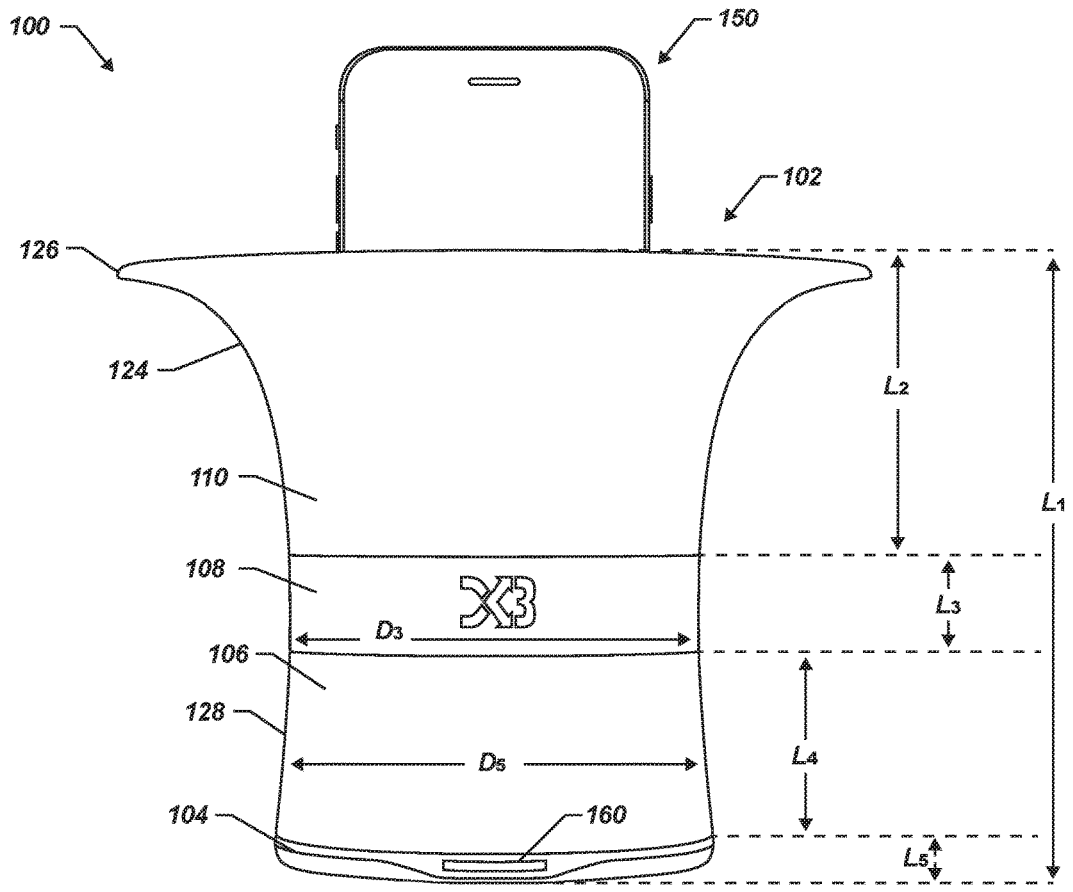
FIG. 3 is a front view of the passive sound proliferation device of FIG. 1.

FIG. 3 is a front view of the passive sound proliferation device 100. In some embodiments, such as where the electronic device 150 is a phone, the passive sound proliferation device 100 may have a total length $L_1$ between about 110 mm and about 140 mm, such as between about 115 mm and about 135 mm or between about 120 mm and about 130 mm. In some embodiments, the total length $L_1$ is about 125 mm. The top portion 110 may have a length $L_2$ defined as a distance from the opening 102 to the surface 120 (FIG. 2). The length $L_2$ may be between about 60 mm and about 80 mm, such as between about 65 mm and about 75 mm. In some embodiments, the length $L_2$ may be about 70 mm. The middle portion 108 may have a length $L_3$ of between about 10 mm and about 30 mm, such as between about 15 mm and about 25 mm. In some embodiments, the length $L_3$ is about 20 mm. A length $L_4$ of the base portion 106 may be between about 10 mm and about 40 mm, such as between about 15 mm and about 35 mm, between about 20 mm and about 30 mm, or between about 25 mm and about 30 mm. In some embodiments, the length $L_4$ is about 28 mm. A length $L_5$ of the base plate 104 may be between about 2 mm and about 10 mm, such as between about 4 mm and about 8 mm. In some embodiments, the length $L_5$ of the base plate 104 is about 6 mm. In embodiments where the electronic device 150 comprises a larger electronic device, $L_1$ may be between about 120 mm and about 150 mm, such as between about 130 mm and about 140 mm. In some embodiments, $L_1$ is about 135 mm. In some such embodiments, $L_4$ may be between about 30 mm and about 60 mm, such as between about 35 mm and about 55 mm, or between about 40 mm and about 50 mm. In some embodiments, $L_4$ is about 45 mm.

The top portion 110 may include and be partially defined by curved (e.g., arcuate) surfaces 124 having a predefined curvature (i.e., an amount by which the surfaces of the top portion 110 deviate from being planar). In some embodiments, the top portion 110 may be horn-shaped, vase-shaped, or may include other shapes with curved surfaces 124. Portions of the top portion 110 proximate the opening 102 may exhibit a different rate of change of curvature than portions of the top portion 110 proximate the middle portion 108. For example, a rate of change of curvature of the curved surfaces 124 may be greater near the top of the passive sound proliferation device 100 than proximate the middle portion 108.

A cross-sectional area of the top portion 110 may vary along a longitudinal axis of the passive sound proliferation device 100. The cross-sectional area may increase from proximate the middle portion 108 to the opening 102. Thus, the audio cavity 116 (FIG. 2) may exhibit a larger cross-sectional area proximate the opening 102 than proximate the middle portion 108. In some embodiments, a cross-section of the top portion 110 may be elliptical-shaped. In some embodiments, the cross-sectional shape of the top portion 110 may have an eccentricity between about 0.5 and 0.999, such as between about 0.5 and about 0.6, between about 0.6 and about 0.7, between about 0.7 and about 0.8, between about 0.8 and about 0.9, or between about 0.9 and about 0.999. As described above, a shape of the cross-sectional area of the opening 102 may vary along a length of the passive sound proliferation device 100.

The top portion 110 may include a lip 126 extending circumferentially around the top portion 110 and having a larger cross-sectional area than other portions of the top portion 110. The lip 126 may culminate in the opening 102. The lip 126 may have a cross-sectional area having the same shape as the opening 102, and having a larger cross-sectional area than other portions of the top portion 110. The cross-sectional area of the top portion 110 may range from a cross-sectional area equal to about a cross-sectional area of the middle portion 108 proximate the middle portion 108 to a cross-sectional area of the opening 102 proximate the opening 102.

The middle portion 108 may include a substantially uniform cross-sectional area along a longitudinal axis of the passive sound proliferation device 100. In some embodiments, the middle portion 108 may have a cross-section having the same shape as a cross-section of the top portion 110. A major axis of the cross-section of the middle portion 108 may have a length $D_3$ between about 70 mm and about 90 mm, such as between about 75 mm and about 85 mm or between about 85 mm and about 90 mm. In some embodiments, $D_3$ may be about 86 mm. A minor axis of the middle portion 108 may have a length $D_4$ (illustrated in FIG. 4) of about 30 mm and about 40 mm, such as between about 32 mm and about 38 mm. In some embodiments, $D_4$ may be about 36 mm. In some embodiments, such as where the electronic device 150 (FIG. 1) comprises a larger electronic device (e.g., a larger telephone), $D_3$ may be between about 90 mm and about 120 mm, such as between about 95 mm and about 115 mm, or between about 100 mm and about 110 mm. In some embodiments, $D_3$ is about 105 mm. In some such embodiments, $D_4$ is between about 40 mm and about 50 mm, such as between about 42 mm and about 48 mm. In some embodiments, $D_4$ is about 44 mm.

The base portion 106 may be defined by a curved surface 128 extending from the base plate 104 to the middle portion 108. A rate of change of curvature of the curved surface 128 may be less than a rate of change of the curved surface 124. The base portion 106 may have a larger cross-sectional area proximate the base plate 104 than proximate the middle portion 108. The cross-section of the base portion 106 may be defined by an oval shape, an elongated circular shape, an elliptical shape, a rectangular shape, etc., a major axis of which may have a length $D_5$ and a minor axis of which may have a length of $D_6$ (illustrated in FIG. 4). In some embodiments, $D_5$ may be equal to approximately $D_3$ proximate the middle portion 108 and may increase from a location proximate the middle portion 108 to a location proximate the base plate 104. $D_5$ may be between about 90 mm and about 100 mm, such as between about 90 mm and about 95 mm proximate the base plate 104. In some embodiments, $D_5$ may be about 93 mm proximate the base plate 104. In some embodiments, $D_6$ may be equal to approximately $D_4$ proximate the middle portion 108 and may increase from a location proximate the middle portion 108 to a location proximate the base plate 104. In some embodiments, $D_6$ may be between about 55 mm and about 75 mm, such as between about 60 mm and about 70 mm proximate the base plate 104. In some embodiments, $D_6$ may be about 65 mm proximate the base plate 104. In some embodiments, such as where the electronic device 150 (FIG. 1) comprises a larger electronic device, such as a larger telephone, $D_5$ may be between about 100 mm and about 130 mm, such as between about 105 mm and about 125 mm, or between about 110 mm and about 120 mm. In some embodiments, $D_5$ is about 115 mm. In some such embodiments, $D_6$ may be equal to about 60 mm and about 90 mm, such as between about 65 mm and about 85 mm, or between about 70 mm and about 80 mm. In some embodiments, $D_6$ is about 75 mm.

In some embodiments, the cross-sectional shape of the base portion 106 is elliptical having an eccentricity between about 0.5 and 0.999, such as between about 0.5 and about 0.6, between about 0.6 and about 0.7, between about 0.7 and about 0.8, between about 0.8 and about 0.9, or between about 0.9 and about 0.999.

Figure 4:
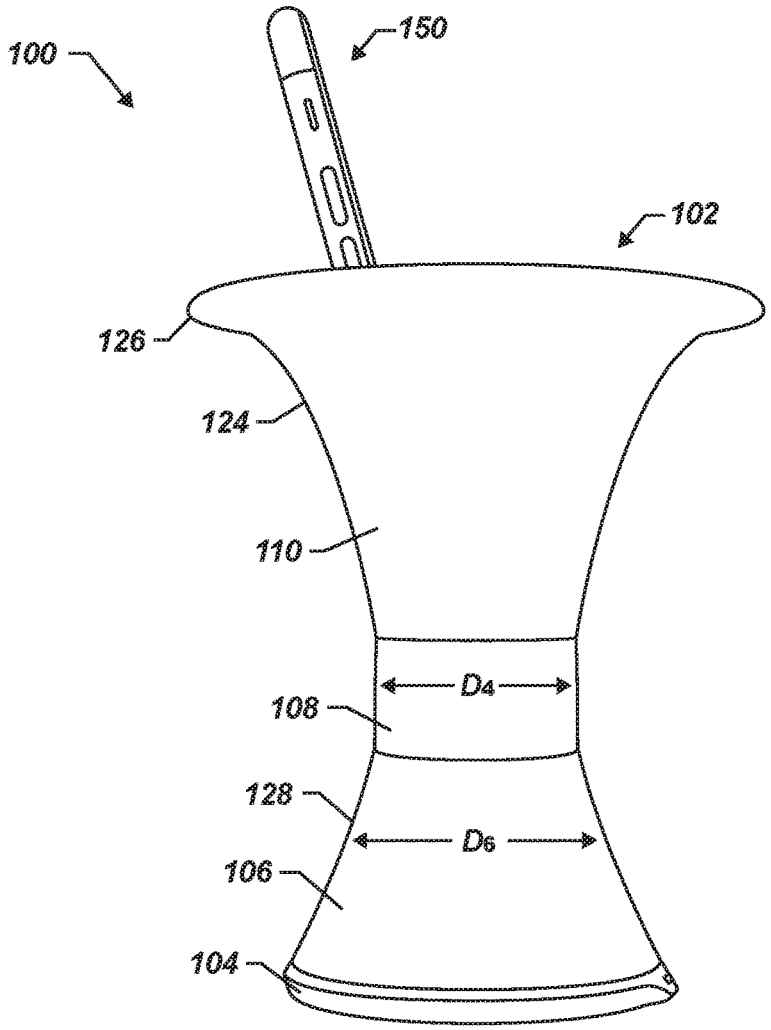
FIG. 4 is a side view of the passive sound proliferation device of FIG. 1.

FIG. 4 is a side view of the passive sound proliferation device 100. FIG. 4 illustrates relative dimensions of the minor axes (e.g., $D_4$, $D_6$) of the cross-sections of the passive sound proliferation device 100.

Figure 5:
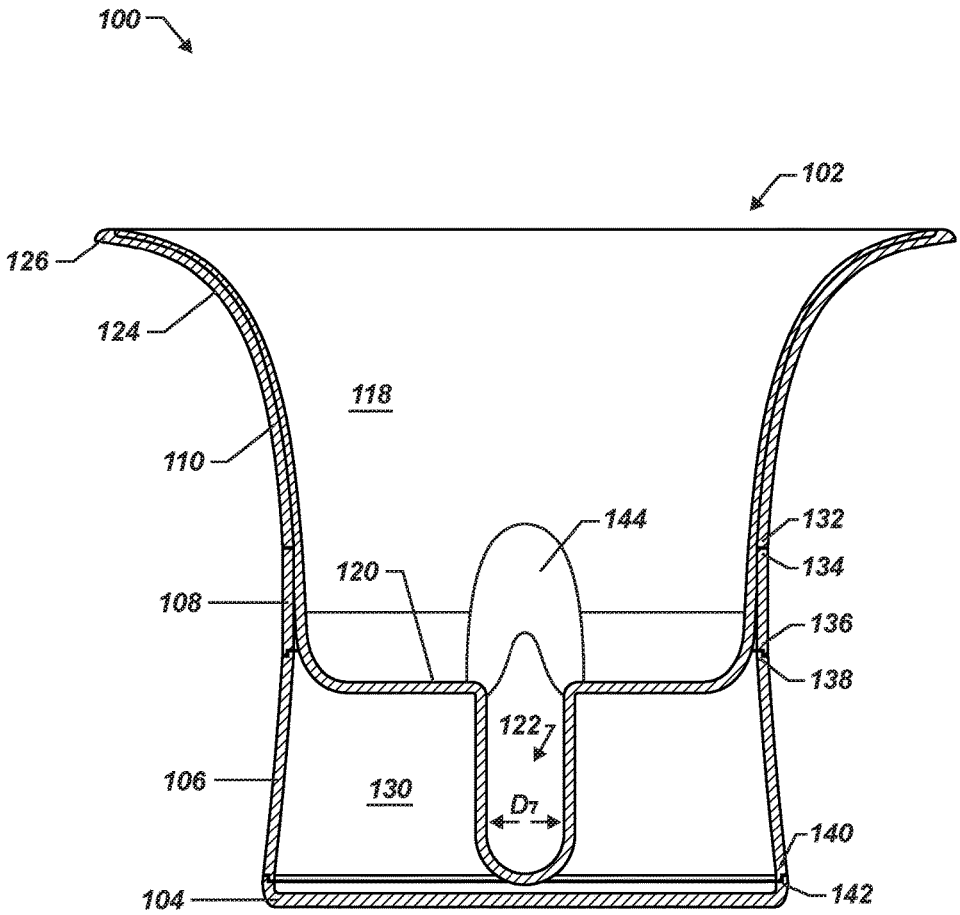
FIG. 5 is a front sectional view of the passive sound proliferation device of FIG. 1.

FIG. 5 is a front sectional view of the passive sound proliferation device 100. Each of the base plate 104, the base portion 106, the middle portion 108, and the top portion 110 may be attached to each other via one or more connection means. In some embodiments, the top portion 110 may include a connection means 132 configured to fixedly engage with a connection means 134 of the middle portion 108. The connection means 132 may include a male threaded portion configured to matingly engage with connection means 134, which may include a female threaded portion. In other embodiments, the connection means 132 may include a bayonet mount (also known as a bayonet connector) with at least one radial pin and the connection means 134 may include a matching receptor configured to receive the at least one radial pin. In yet other embodiments, the connection means 132, 134 may include a snap-type connector, a slide on coupling mechanism, or other suitable connection means.

The middle portion 108 may further include a connection means 136 configured to engage with a connection means 138 of the base portion 106. The connection means 136, 138 may be any of a bayonet connection means, a snap-type connector, a slide on coupling mechanism, or other suitable connection means. The connection means 136 may be configured to interact with connection means 138. The base portion 106 may further include a connection means 140 configured to interact with a connection means 142 of the base plate 104. The connection means 140, 142 may include any of a bayonet connection means, a snap-type connector, a slide on coupling mechanism, or other suitable connection means.

In some embodiments, each of the top portion 110, the middle portion 108, the base portion 106, and the base plate 104 may be welded or glued together to form a substantially hermetic seal. By way of nonlimiting example, the top portion 110 may be welded or glued to the middle portion 108 proximate the connection means 132, 134, the middle portion 108 may be welded or glued to the base portion 106 proximate the connection means 136, 138, and the base portion 106 may be welded or glued to the base plate 104 proximate the connection means 140, 142. Welding may be performed by methods known in the art, such as, for example, ultrasonic welding, hot gas welding (also known as hot air welding), using a welding rod (such as a thermoplastic welding rod), heat sealing, speed tip welding, contact welding, or other methods for welding the materials of the passive sound proliferation device 100. In other embodiments, an adhesive material, such as an epoxy, a resin, or other adhesive material, may be used to adhere the top portion 110, the middle portion 108, the base portion 106, and the base plate 104 together proximate their respective connection means.

The internal cavity 122 may extend from the surface 120, through the base portion 106, and to a location proximate the base plate 104. The internal cavity 122 may be partially defined by an oval, an elongated circular, an elliptical, a rectangular, etc., cross-sectional shape. The cross-sectional shape may have a minor axis having a dimension $D_7$, which may be between about 10 mm and about 20 mm, such as between about 12 mm and about 18 mm. In some embodiments, $D_7$ is about 15 mm. The internal cavity 122 may extend from the surface 120 to a location proximate a bottom portion of the base portion 106.

Figure 7:
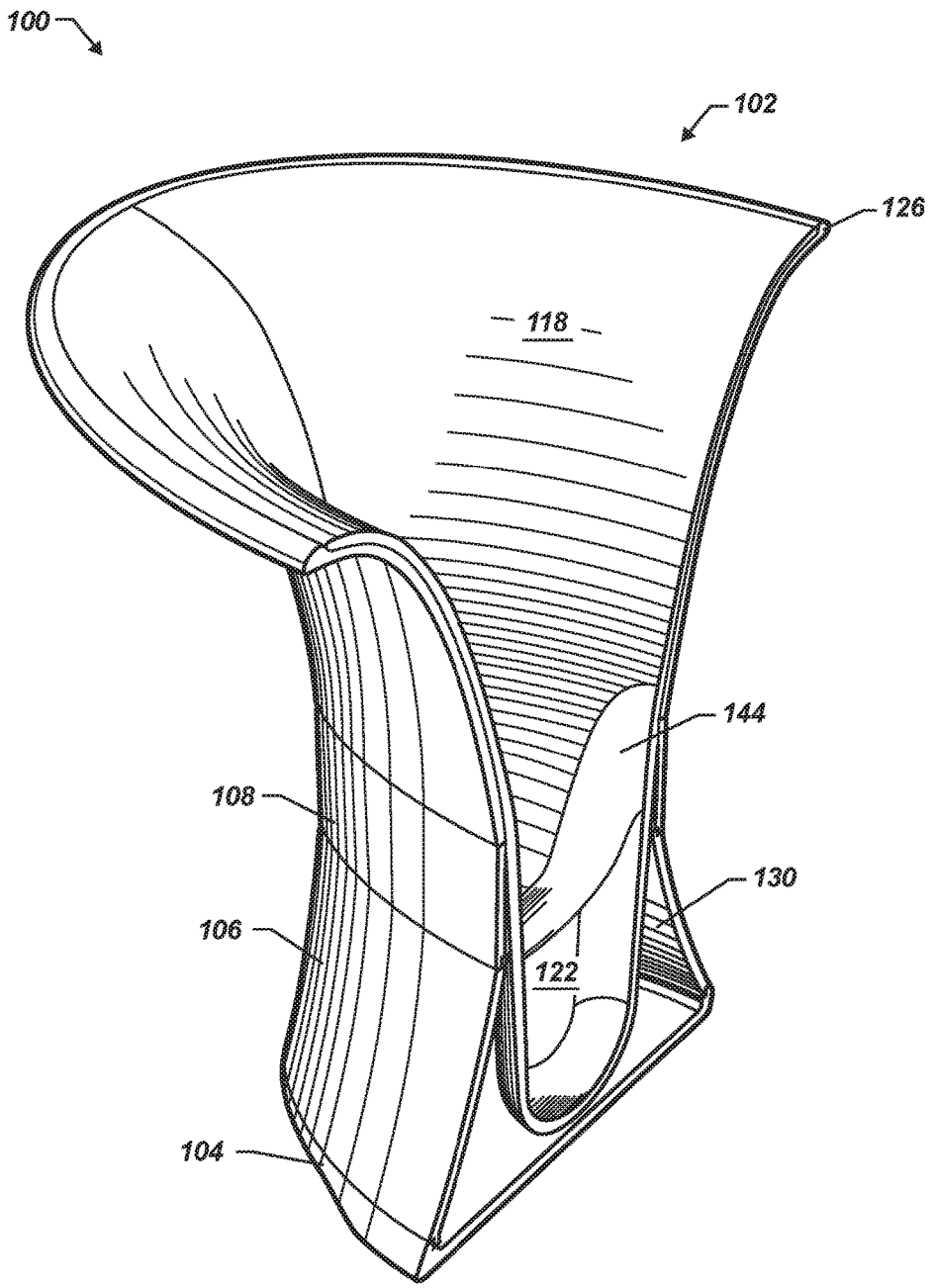
FIG. 7 is a perspective view of the passive sound proliferation device of FIG. 1, cut away through a vertical cross-section of the device.

With continued reference to FIG. 5, in some embodiments, internal surfaces of the base portion 106 may include a textured surface 130. A transition region 144 between the internal cavity 122 and the internal surfaces 118 of the audio cavity 116 (FIG. 1, FIG. 2) may be defined by rounded surfaces. Thus, in some embodiments, the transition region 144 may comprise rounded surfaces substantially free of any corners (e.g., 90° corners). The transition region 144 is more clearly illustrated in FIG. 7, which is a perspective view of the passive sound proliferation device 100 cut away through a vertical cross-section of the device.

Figure 6:
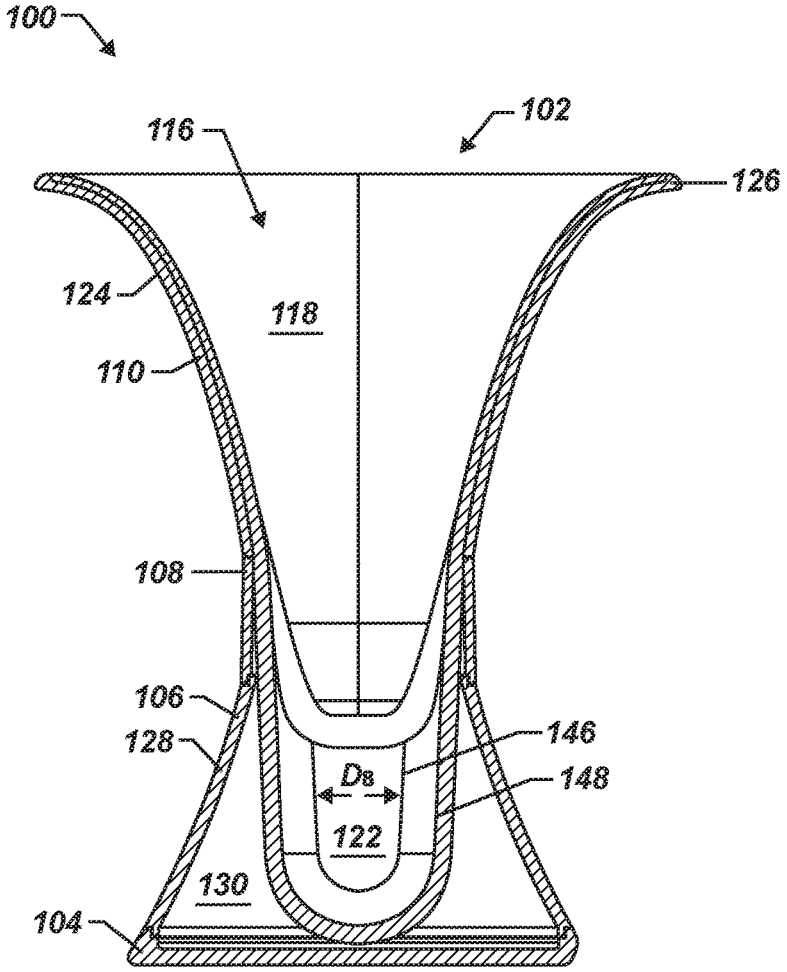
FIG. 6 is a side sectional view of the passive sound proliferation device of FIG. 1.

Referring to FIG. 6, a side sectional view of the passive sound proliferation device 100 is illustrated. A major axis of the cross-section of the internal cavity 122 may have a dimension $D_8$ between about 25 mm and about 35 mm, such as between about 30 mm and about 35 mm. In some embodiments, $D_8$ is about 31 mm proximate the surface 120 (FIG. 5) and about 27 mm proximate the base plate 104.

As described above with reference to FIG. 2, the internal cavity 122 may be sized and configured to retain a power cable for the electronic device 150 (FIG. 1) during use and operation of the passive sound proliferation device 100. Thus, the passive sound proliferation device 100 may be configured to charge a battery of the electronic device 150 during use and operation. In other embodiments, the electronic device 150 may not be connected to a power supply during use and operation of the passive sound proliferation device 100. The internal cavity 122 may be partially defined by an internal wall 146 and an external wall 148. A volume between the internal wall 146 and the external wall 148 may define an internal volume sized and shaped to receive a power cable of the electronic device 150 (FIG. 1). A power cable 152 (FIG. 8) may exit the internal cavity 122 along an outer edge of the audio cavity 116 and may exit the audio cavity 116 proximate the lip 126.

Figure 8:
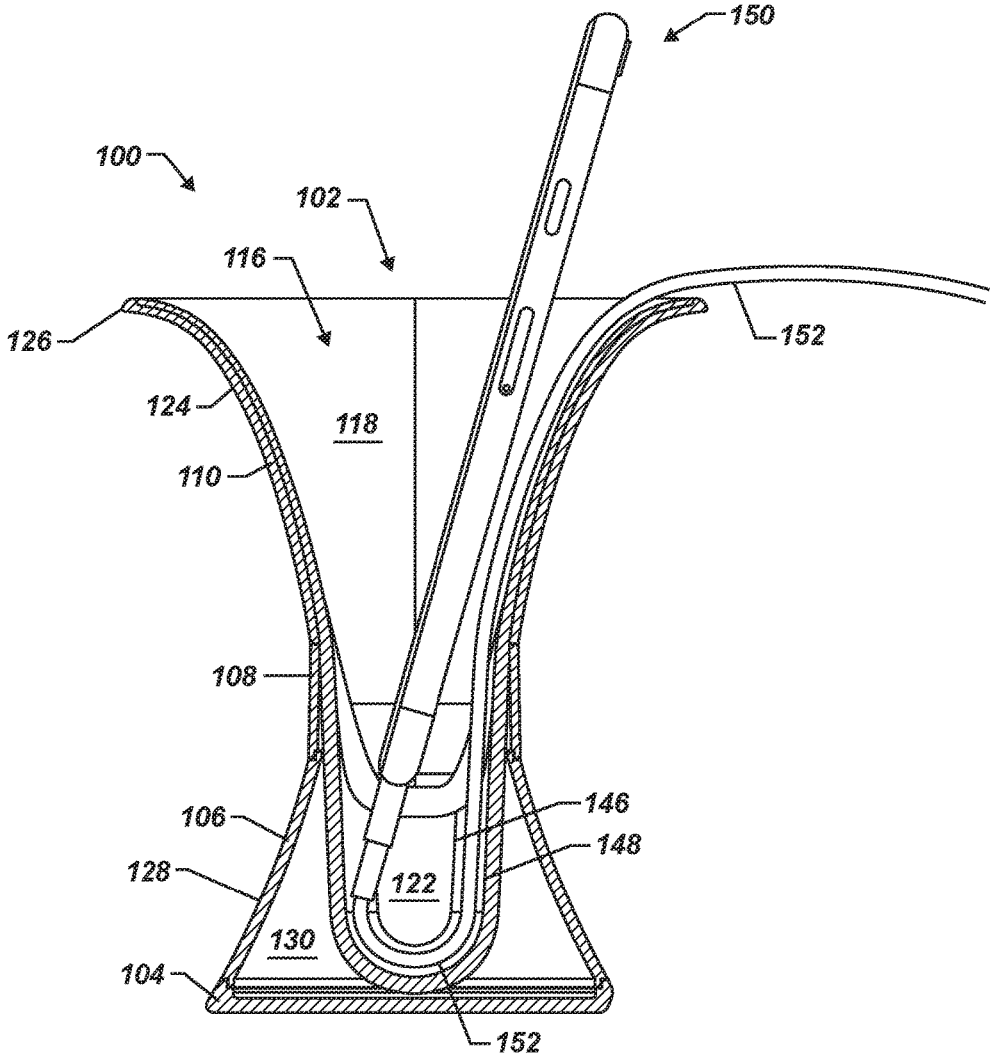
FIG. 8 is a cross-sectional side view of the passive sound proliferation device of FIG. 1, and illustrates an internal cavity for receiving a power cable in accordance with an embodiment of the disclosure.

FIG. 8 illustrates a cross-sectional side view of the passive sound proliferation device 100 and illustrates the internal cavity 122 with the power cable 152 disposed therein. As illustrated, the internal cavity 122 may accommodate a power cable 152 of the electronic device 150 so that the electronic device 150 may be charged during use and operation of the passive sound proliferation device 100. The power cable 152 may exit the internal cavity 122 along an outer edge of the audio cavity 116 and may exit the audio cavity 116 proximate the lip 126.

Figure 9:
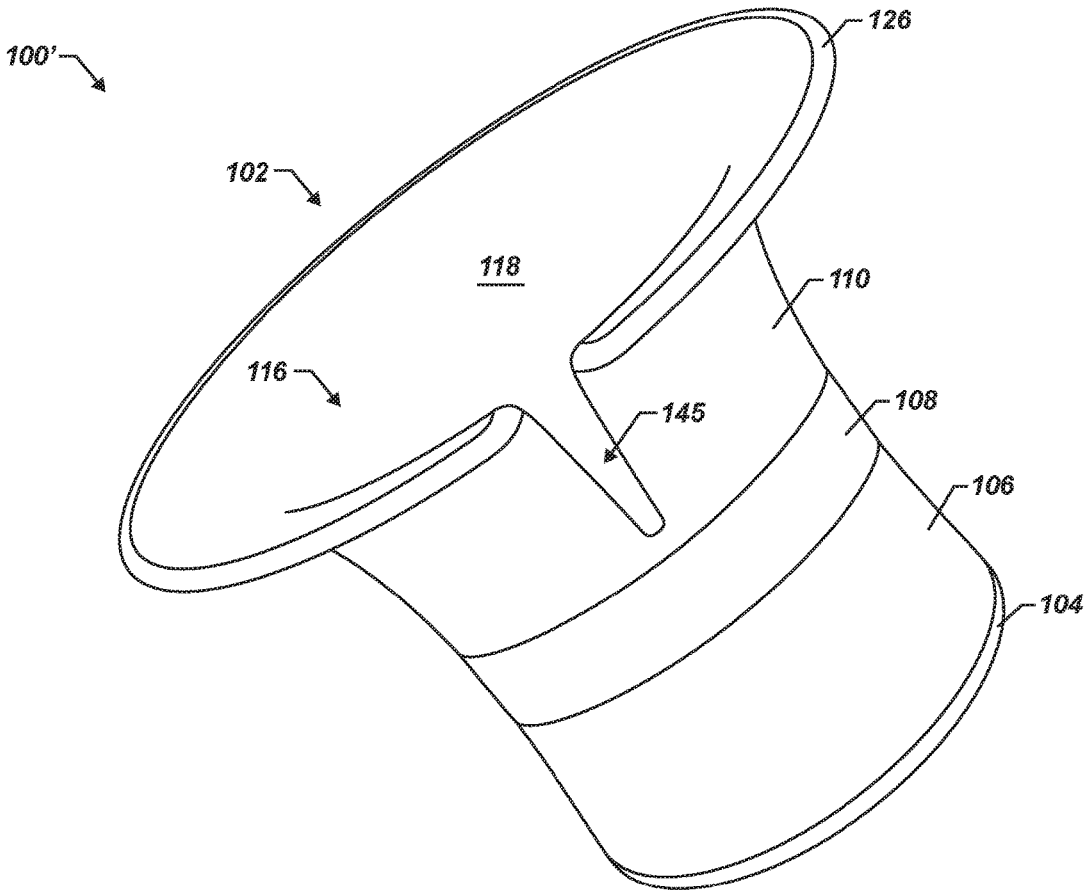
FIG. 9 is a simplified perspective view of a passive sound proliferation device in accordance with other embodiments of the disclosure.

FIG. 9 illustrates a perspective view of another embodiment of a passive sound proliferation device 100'. The passive sound proliferation device 100' may be substantially the same as the passive sound proliferation device 100 (FIG. 1), except that the passive sound proliferation device 100' includes a slot 145 for receiving a power cable. A power cable may exit the passive sound proliferation device 100' from the slot 145 rather than through the opening 102. In some such embodiments, the electronic device 150 (FIG. 1) may be configured to rest on an interior surface 118 opposite the slot 145. In other embodiments, the electronic device 150 may be configured to rest on the interior surface proximate the slot 145.

Although the passive sound proliferation device 100 has been described in some embodiments as having particular dimensions, the passive sound proliferation device 100 is not so limited. The passive sound proliferation device 100 may be sized and shaped such that electronic devices of various sizes may be disposed therein. For example, the passive sound proliferation device 100 may be sized such that mobile telephones of various sizes may be disposed therein. In other embodiments, the passive sound proliferation device 100 is sized and shaped such that an iPAD®, a Notebook, a tablet, or another electronic device may be disposed therein.

Figure 10:
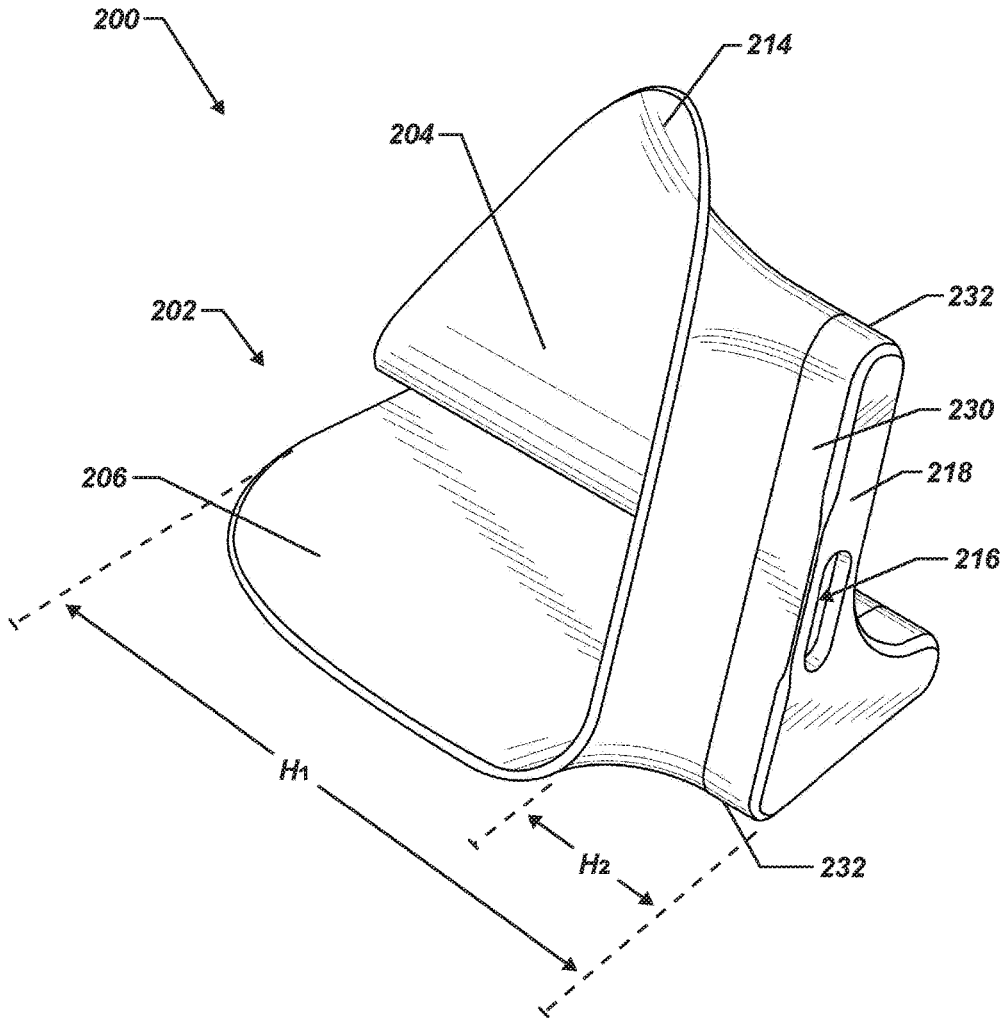
FIG. 10 through FIG. 12 are simplified perspective views of a passive sound proliferation device in accordance with yet other embodiments of the disclosure.
Figure 11:
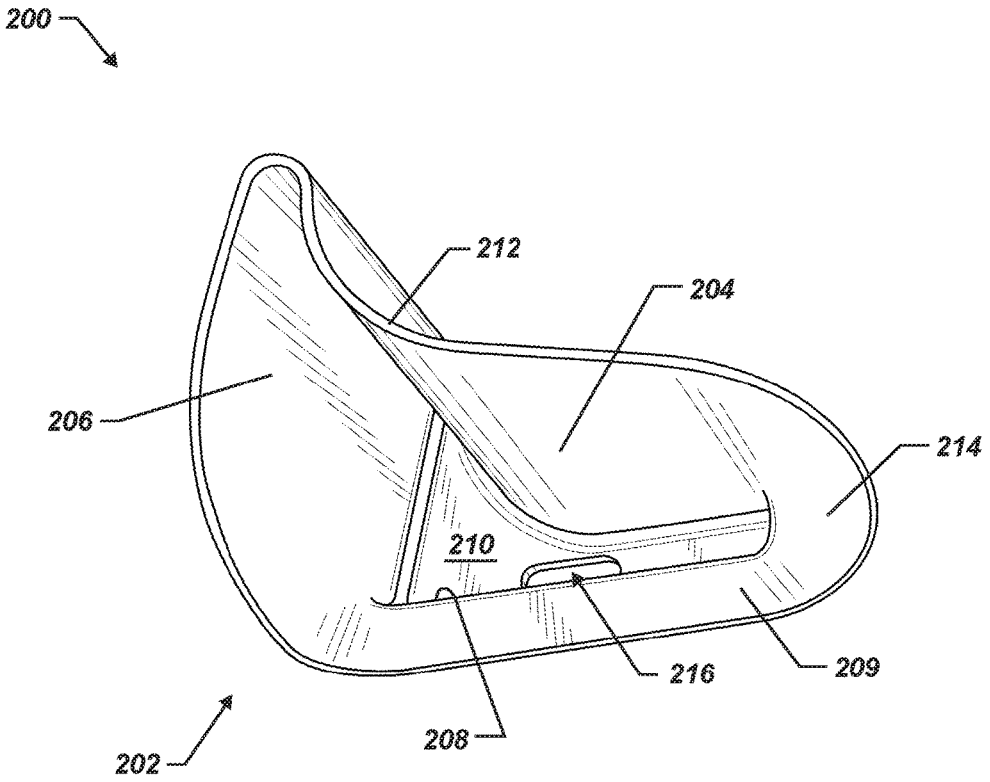
Figure 12:
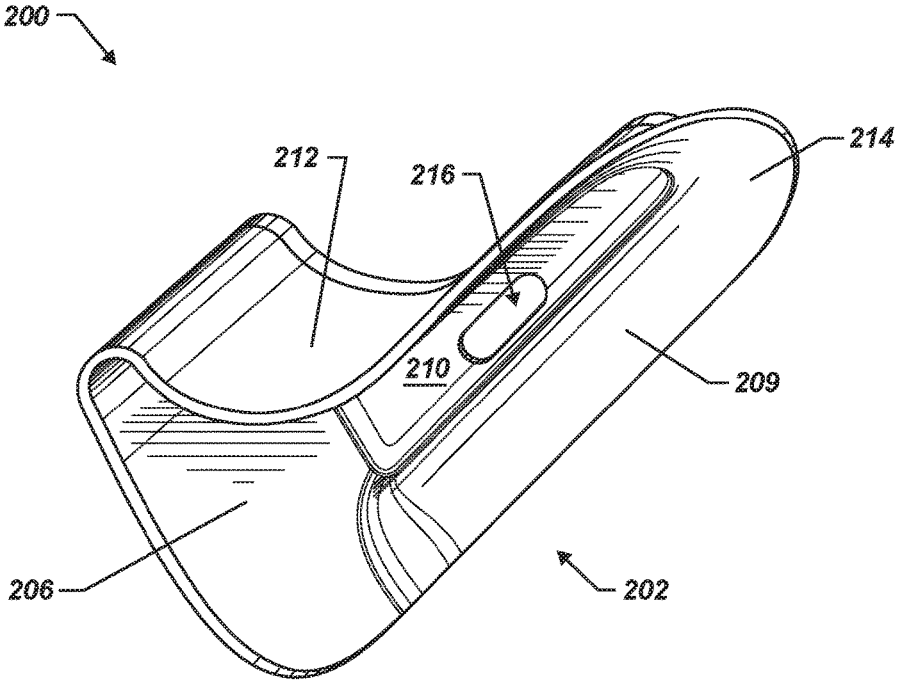

FIG. 10 through FIG. 18 illustrate another embodiment of a passive sound proliferation device 200. FIG. 10 through FIG. 12 are perspective views of the passive sound proliferation device 200, in accordance with other embodiments of the disclosure. The passive sound proliferation device 200 may be configured to receive an electronic device and may further be configured to be oriented in one or more configurations to facilitate viewing an electronic device disposed therein in different configurations.

Figure 13:
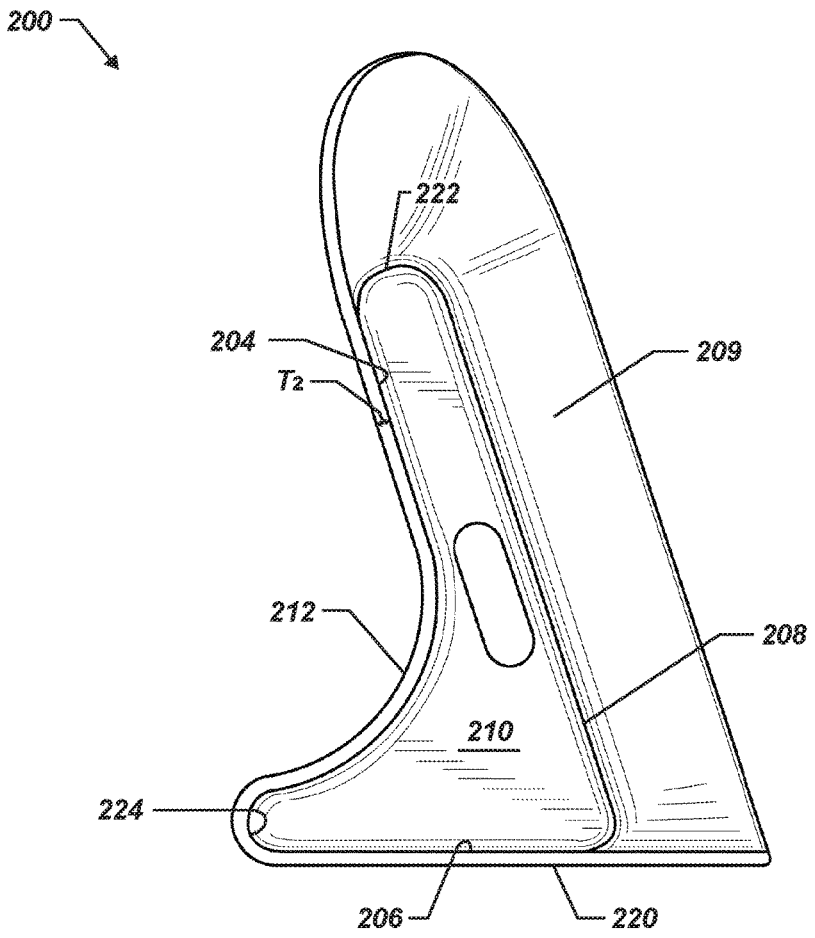
FIG. 13 is a top view of the passive sound proliferation device of FIG. 10 through FIG. 12.

The passive sound proliferation device 200 may define an audio cavity 202, which may be shaped and configured to direct acoustic waves in one or more directions away from the passive sound proliferation device 200. The audio cavity 202 may be at least partially defined by a back wall 204, a side wall 206, and a front wall 208 (FIG. 13). The back wall 204 and the side wall 206 may comprise a substantially planar surface. The audio cavity 202 may further be defined by a substantially planar bottom surface 210. The back wall 204, the side wall 206, and the front wall 208 defining the audio cavity 202 may be sized and shaped such that an electronic device may be retained within the audio cavity 202, while a portion of electronic device may be viewed from a front of the passive sound proliferation device 200 (e.g., when facing the front wall 208). Stated another way, the front wall 208 of the passive sound proliferation device 200 may be sized and shaped such that a screen of the electronic device may not be substantially obstructed from a view of a user. By way of nonlimiting example, the front wall 208 may have a height $H_2$ that is less than an overall height $H_1$ of the passive sound proliferation device 200. In some embodiments, $H_2$ may be less than or equal to about 50 percent of $H_1$, such as less than or equal to about 40 percent of $H_1$, less than or equal to about 30 percent of $H_1$, less than or equal to about 20 percent of $H_1$, or less than or equal to about 10 percent of $H_1$. In some embodiments, a height of the side wall 206 may be greater than a height of the back wall 204. In some embodiments, the back wall 204 may angle downwardly toward the substantially planar bottom surface 210 as the back wall 204 extends from a portion proximate the side wall 206 to a portion proximate the front wall 208.

In some embodiments, the back wall 204 may contact a major surface of an electronic device when the electronic device is disposed in the audio cavity 202. While the back wall 204 contacts the major surface of the electronic device, a front surface of the electronic device (e.g., a surface comprising, for example, a screen) may be visible to a user. The front wall 208 may contact a portion of the front surface of the electronic device. In some such embodiments, the passive sound proliferation device 200 may be configured such that the electronic device may be angled in the audio cavity 202 (e.g., a portion of a back surface of the electronic device may contact the back wall 204 and a portion of the front surface of the electronic device may contact the front wall 208). In other embodiments, the audio cavity 202 may be configured such that substantially all of a back surface of the electronic device may contact the back wall 204.

With reference to FIG. 11, the audio cavity 202 may further be defined by arcuate surfaces 212 connecting the back wall 204 to the side wall 206. A curved surface 214 may connect the back wall 204 to the front wall 208. In some embodiments, the curved surface 214 may direct acoustic waves from the audio cavity to directions away therefrom. In some embodiments, the curved surface 214 may be shaped similar to a horn, may exhibit a frustoconical shape, or may exhibit a bowl-shape. In some embodiments, the audio cavity 202 may flare outwardly at the curved surface 214. The front wall 208 may include a lip 209 defined by a surface extending outwardly in a direction away from the audio cavity 202. In some embodiments, the lip 209 comprises a substantially planar surface extending in a direction orthogonal to a longitudinal axis of the passive sound proliferation device 200 (i.e., in a direction orthogonal to a height $H_1$ (FIG. 10) of the passive sound proliferation device 200).

As described above, the back wall 204 may be configured to contact a substantially planar surface of an electronic device when the electronic device is received in the audio cavity 202. In some embodiments, the substantially planar bottom surface 210 may be configured to receive or contact a portion of an electronic device configured to receive an electrical input (e.g., a power input, such as from a power cord). The passive sound proliferation device 200 may include an opening 216 configured to receive a power input of the electronic device. Accordingly, in some embodiments, the passive sound proliferation device 200 may be configured to facilitate charging the electronic device while the electronic device is received by the passive sound proliferation device 200.

Although the passive sound proliferation device 200 has been described as including an opening 216 configured to receive a power cord, the disclosure is not so limited. In other embodiments, the passive sound proliferation device 200 may be configured such that an electronic device may be operably coupled thereto to charge or provide power to the electronic device. By way of nonlimiting example, the passive sound proliferation device 200 may comprise a male adapter (e.g., a male power input) configured to operably couple (e.g., be input into) an electrical device. In some such embodiments, the passive sound proliferation device 200 may comprise a power input configured to receive power from a power source and provide power to the male adapter. The male adapter may be disposed within the audio cavity 202 in a position such that the electronic device may be disposed in the audio cavity 202 and operably coupled to the male adapter. In some embodiments, the male adapter may be positioned on the substantially planar bottom surface 210.

Figure 14:
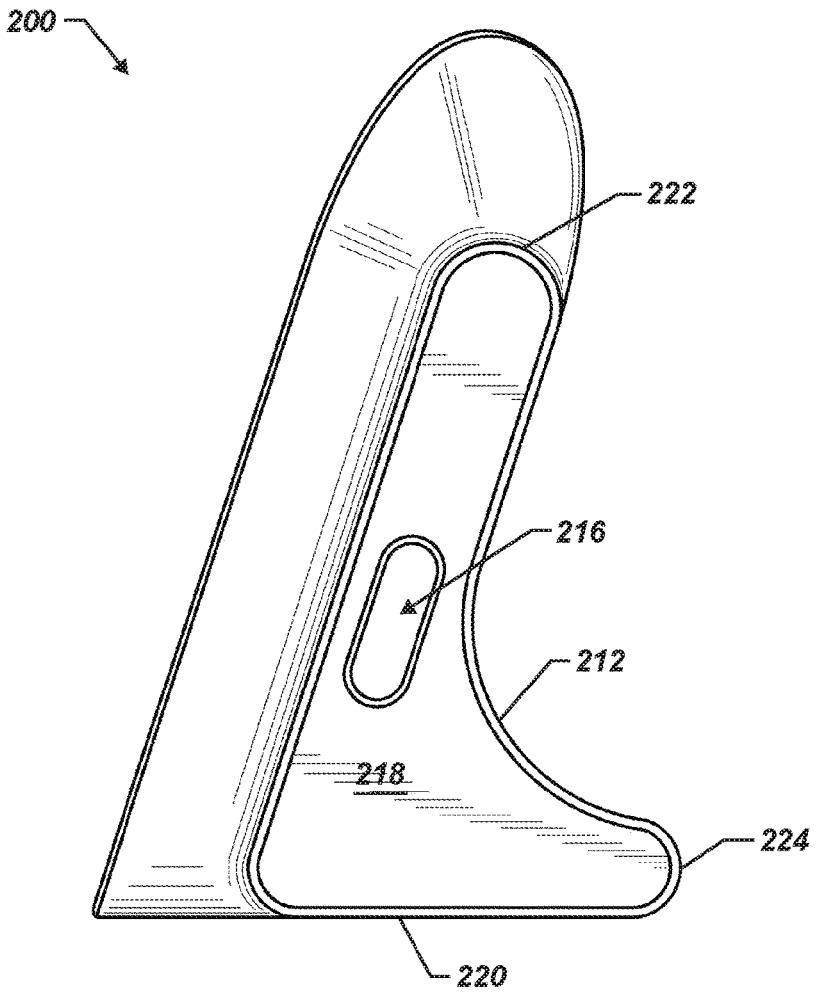
FIG. 14 is a bottom view of the passive sound proliferation device of FIG. 10 through FIG. 12.

FIG. 13 and FIG. 14 are a respective top view and bottom view of the passive sound proliferation device 200. A cross-section of the passive sound proliferation device 200 may be defined by an L-shape. The L-shape may be defined by the side wall 206, the front wall 208, a semicircular portion 222 between the front wall 208 and the back wall 204, the arcuate surface 212, and another semicircular portion 224 between the arcuate surface 212 and the side wall 206.

Figure 15:
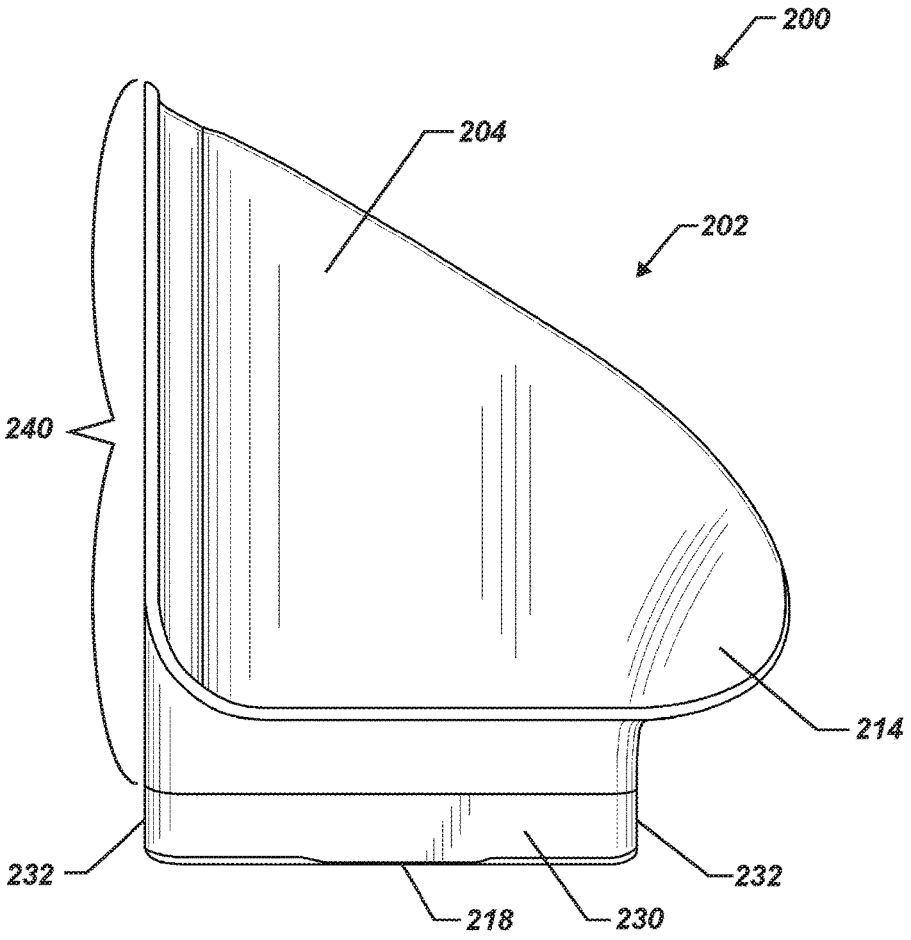
FIG. 15 is a front view of the passive sound proliferation device of FIG. 10 through FIG. 12.
Figure 16:
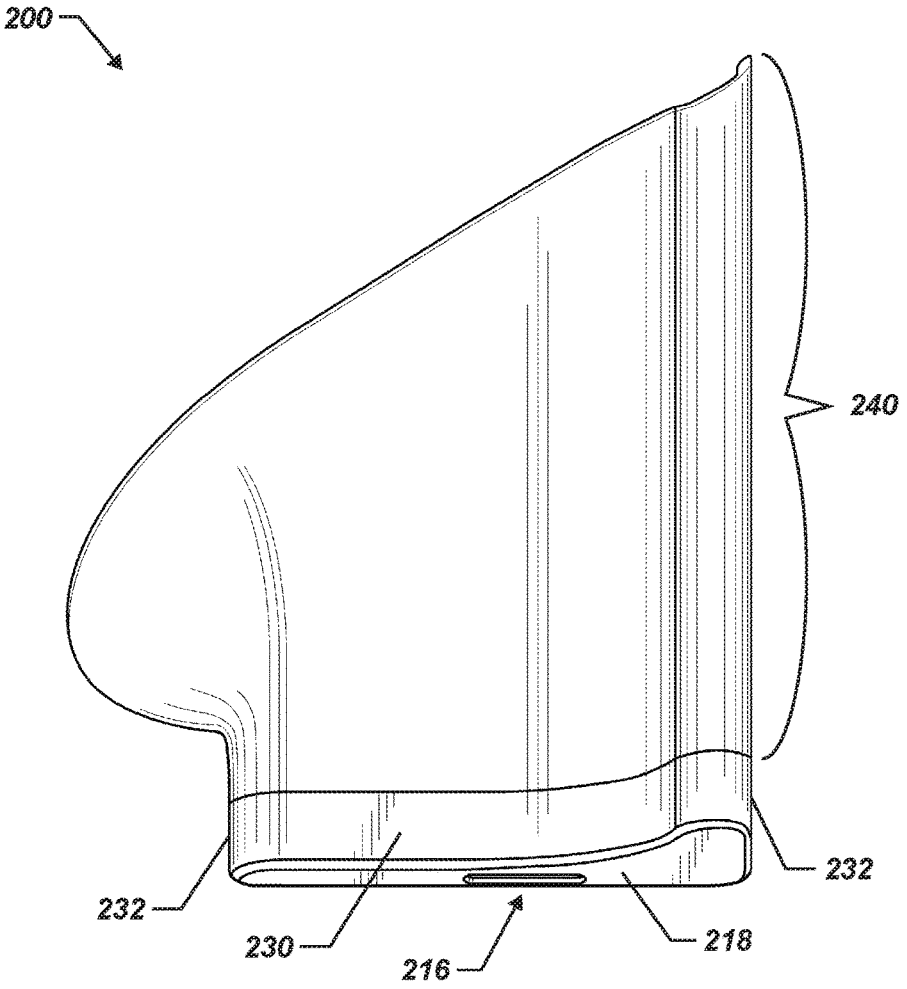
FIG. 16 is a back view of the passive sound proliferation device of FIG. 10 through FIG. 12.

With reference to FIGS. 10, 15, and 16, the passive sound proliferation device 200 may include a base portion 230. The base portion 230 may include substantially straight sidewalls 232. At least one of the sidewalls 232 may transition into the curved surface 214 and an opposing sidewall 232 may transition into an outer side surface 220 (FIG. 13 and FIG. 14). The base portion 230 may be operably coupled to a body portion 240 of the passive sound proliferation device 200. In some embodiments, the base portion 230 may be operably coupled to the body 240 via one or more connection means, which may comprise, for example, a bayonet mount with at least one radial pin and a matching receptor configured to receive the at least one radial pin. In other embodiments, the connection means may include a snap-type connector, a slide on coupling mechanism, or other suitable connection means, as described above with reference to FIG. 5 and the passive sound proliferation device 100.

Figure 17:
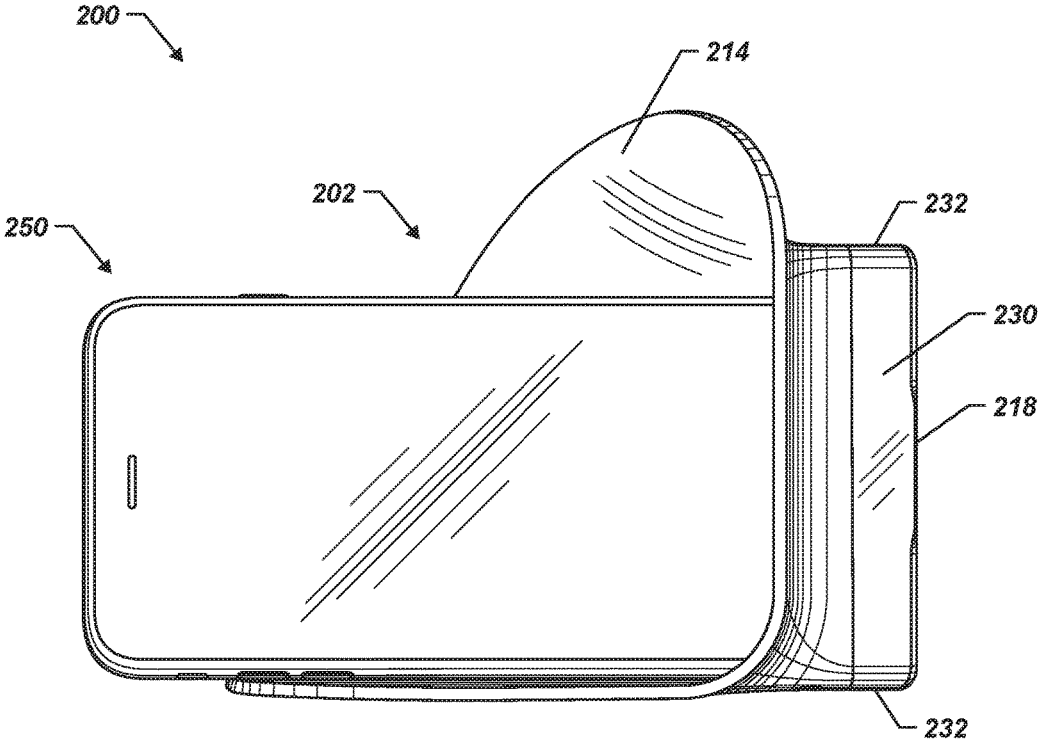
FIG. 17 is a front view of the passive sound proliferation device of FIG. 10 through FIG. 12 with an electronic device therein oriented in a landscape mode.

FIG. 17 is a front view of the passive sound proliferation device 200 with the electronic device 250 disposed therein. The passive sound proliferation device 200 may be oriented such that the electronic device 250 is oriented in a so-called "landscape" mode. In some such embodiments, the passive sound proliferation device 200 may be positioned on a surface (e.g., on a desk, table, countertop, etc.) such that the outer side surface 220 (FIG. 13 and FIG. 14) contacts the surface. In some such embodiments, a longitudinal axis of the electronic device 250 may be substantially perpendicular to an outer bottom surface 218 and to the surface on which the passive sound proliferation device 200 rests. The outer side surface 220 may oppose the side wall 206 partially defining the audio cavity 202. In some embodiments, the outer side surface 220 may include a textured surface, one or more ribs, or a combination thereof configured to facilitate frictional engagement between the outer side surface 220 and the surface in contact therewith.

Figure 18:
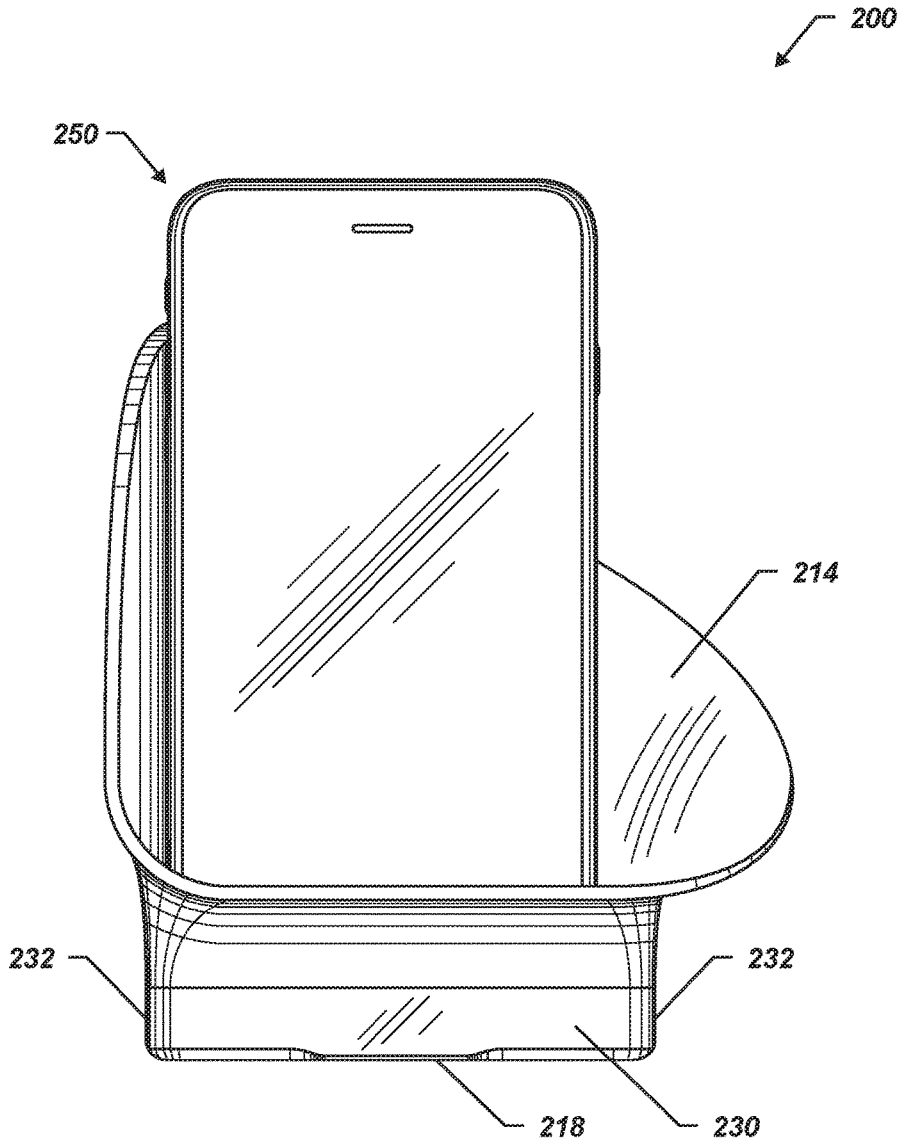
FIG. 18 is a front view of the passive sound proliferation device of FIG. 10 through FIG. 12 with an electronic device therein and oriented in a portrait mode.

FIG. 18 is a front view of the passive sound proliferation device 200 with an electronic device 250 disposed therein. The passive sound proliferation device 200 may be oriented such that the electronic device 250 is oriented in a so-called "portrait" mode. In some such embodiments, the passive sound proliferation device 200 may be positioned on a surface (e.g., on a desk, table, countertop, etc.) such that the outer bottom surface 218 (FIG. 10 and FIG. 14 through FIG. 16 and FIG. 18) of the passive sound proliferation device 200 contacts the surface. In some such embodiments, a longitudinal axis of the electronic device 250 may be substantially parallel to the outer side surface 220 (FIG. 13, FIG. 14), which may also be substantially parallel to the surface on which the passive sound proliferation device 200 rests. The outer bottom surface 218 may oppose the planar bottom surface 210 (FIG. 13) partially defining the audio cavity 202. In some embodiments, the outer bottom surface 218 may include a textured surface, one or more ribs, or a combination thereof configured to facilitate frictional engagement between the outer bottom surface 218 and the surface in contact therewith.

The passive sound proliferation device 200 may be formed of and include substantially the same materials as the passive sound proliferation device 100 described above with reference to FIG. 1. A wall thickness $T_2$ (FIG. 13) of the passive sound proliferation device 200 may be substantially the same as the wall thickness T described above with reference to the passive sound proliferation device 100. In some embodiments, the wall thickness $T_2$ may be substantially uniform across portions of the passive sound proliferation device 200 (e.g. as shown in, for example, FIG. 11, FIG. 13, and FIG. 15).

Accordingly, the passive sound proliferation device 100, 100', 200 may be configured to house an electronic device having a speaker. In use and operation, the passive sound proliferation device 100, 200 is configured to direct acoustic waves in a particular direction, giving a user a sense of amplification of the acoustic waves generated from a speaker of the electronic device 150, 250 (FIG. 1, FIG. 3, FIG. 4, FIG. 8, FIG. 17, FIG. 18). By way of nonlimiting example, the passive sound proliferation device 100, 200 may direct audio from an audio cavity through an oval-shaped opening having a larger cross-sectional area than other portions of the audio cavity. The passive sound proliferation device 100, 200 may be provided with an internal cavity configured to accept a power cable of the electronic device. In some embodiments, the passive sound proliferation device 100, 200 may be configured to be oriented such that the electronic device may be viewed in landscape mode or portrait mode. Thus, the passive sound proliferation device 100, 200 may enable a user to comfortably listen to electronic devices from a distance.

While the disclosure is susceptible to various modifications and alternative forms, specific embodiments have been shown by way of example in the drawings and have been described in detail herein. However, the disclosure is not intended to be limited to the particular forms disclosed. Rather, the disclosure is to cover all modifications, equivalents, and alternatives falling within the scope of the disclosure as defined by the following appended claims and their legal equivalents.

What is claimed is:

1. An apparatus, comprising:

a passive sound proliferation device, comprising:

a base portion comprising substantially straight sidewalls;

a body portion coupled to the base portion, the body portion comprising:

a front wall;

a back wall comprising a substantially planar surface extending from a lower inner bottom surface to a top portion of the passive sound proliferation device, a height of the back wall varying;

a curved wall between the front wall and the back wall, the curved wall comprising a curved surface extending from the back wall to the front wall, a height of the curved wall proximate the front wall less than a height of the curved wall proximate the back wall;

another curved wall between the back wall and a side wall, the another curved wall having a different cross-sectional shape than the curved wall; and the side wall between the front wall and the another curved wall, the side wall comprising a substantially planar surface having about a same height as a largest height of the back wall;

wherein a height of the back wall varies from a location proximate the curved wall to a location proximate the another curved wall, the back wall having a greater height than a height of the front wall;

wherein a height of the curved wall is less than a height of the side wall;

wherein the back wall, the front wall, the curved wall, the another curved wall, and the side wall define an audio cavity configured to proliferate acoustic waves therefrom, the audio cavity further configured to receive an electronic device therein;

a substantially planar outer side surface opposing an inner surface of the side wall; and a substantially planar outer bottom surface substantially perpendicular to the substantially planar outer side surface.

2. The apparatus of claim 1, further comprising an electronic device having at least one speaker disposed in the audio cavity.

3. The apparatus of claim 1, wherein at least a portion of the passive sound proliferation device comprises a thermoplastic material.

4. The apparatus of claim 1, wherein at least one of the substantially planar outer side surface and the substantially planar outer bottom surface comprises a textured surface configured to frictionally engage a surface on which the passive sound proliferation device rests.

5. The apparatus of claim 1, further comprising an opening through the substantially planar inner bottom surface and the substantially planar outer bottom surface, the opening configured to receive a power supply for an electronic device.

6. The apparatus of claim 1, wherein a height of the front wall is less than about 20 percent a height of the passive sound proliferation device.

7. The apparatus of claim 1, wherein the audio cavity is configured to receive an electronic device in landscape mode when the substantially planar outer side surface contacts a surface on which the passive sound proliferation device rests.

8. The apparatus of claim 1, wherein the audio cavity is configured to receive an electronic device in portrait mode when the substantially planar outer bottom surface contacts a surface on which the passive sound proliferation device rests.

9. A passive sound proliferation device, comprising:

a base portion; and a body portion coupled to the base portion and including an audio cavity configured to proliferate acoustic waves therefrom and configured to receive an electronic device therein, the audio cavity at least partially defined by:

a back wall;

a front wall;

a first curved wall between the back wall and the front wall;

a second curved wall between the back wall and the side wall, the second curved wall having a different cross-sectional shape than the first curved wall;

a side wall between the front wall and the second curved wall; and an inner bottom surface;

wherein a height of the back wall varies from a location proximate the first curved wall to a location proximate the second curved wall;

wherein a height of the first curved wall is less than a height of the side wall;

wherein the body portion comprises a substantially planar outer side surface opposing an inner surface of the side wall;

wherein the body portion further comprises a substantially planar outer bottom surface opposing the inner bottom surface, wherein the passive sound proliferation device is configured to be disposed on a planar surface on one of the substantially planar outer side surface or the substantially planar outer bottom surface.

10. The passive sound proliferation device of claim 9, wherein the back wall is substantially perpendicular to the side wall.

11. The passive sound proliferation device of claim 9, wherein a height of the front wall is less than a height of each of the side wall and the back wall.

12. The passive sound proliferation device of claim 9, wherein the inner bottom surface defines an opening configured to receive a power input of an electronic device disposed in the audio cavity.

13. A method of directing audio from a passive sound proliferation device, the method comprising:

providing an electronic device in an audio cavity of a passive sound proliferation device;

directing audio from the audio cavity of the passive sound proliferation device away from the passive sound proliferation device, wherein the passive sound proliferation device comprises:

a base portion; and a body portion coupled to the base portion, the body portion comprising:

a substantially planar back wall;

a front wall;

a first curved wall between the substantially planar back wall and the front wall;

a second curved wall between the substantially planar back wall and the front wall, the second curved wall having a different cross-sectional shape than the first curved wall;

a substantially planar side wall between the second curved wall and the front wall; and an inner bottom surface;

wherein a height of the back wall varies from a location proximate the first curved wall to a location proximate the second curved wall;

wherein a height of the first curved wall is less than a height of the substantially planar side wall;

wherein the audio cavity is defined by the substantially planar back wall, the front wall, the substantially planar side wall, the first curved wall, and the second curved wall; and providing an opening in the substantially planar inner bottom surface configured to accept a power cable of the electronic device.

14. The method of claim 13, further comprising electrically coupling the electronic device to the power cable while the electronic device is in the audio cavity.

* * * * *